US005345998A

United States Patent [19]

Itoh

[11] Patent Number: 5,345,998

[45] Date of Patent: Sep. 13, 1994

[54] COOLING DEVICE

[75] Inventor: Akira Itoh, Osaka, Japan

[73] Assignee: Itoh Research & Development Laboratory Co., Ltd., Osaka, Japan

[21] Appl. No.: 90,281

[22] Filed: Jul. 8, 1993

[30] Foreign Application Priority Data

Nov. 27, 1992 [JP] Japan ..... 4-318552

[51] Int. Cl.[5] ..... F28D 15/02

[52] U.S. Cl. ..... 165/86; 165/87; 165/104.25; 165/916

[58] Field of Search ..... 165/86, 87, 104.25, 165/916, 181

[56] References Cited

FOREIGN PATENT DOCUMENTS 49884 5/1981 Japan ..... 165/86

*Primary Examiner*—Albert W. Davis, Jr.
*Attorney, Agent, or Firm*—W. G. Fasse; W. F. Fasse

[57] ABSTRACT

A cooling device includes a liquid chamber having a liquid inlet and a liquid outlet. A bent pipe includes a straight tubular heat pipe component provided extending from the inside to the outside of the liquid chamber. A spiral heat pipe component communicating with the straight tubular heat pipe component and extending to surround the same spirally is provided. In an internal space where the spiral heat pipe component and the straight tubular heat pipe component communicate with each other, a working fluid serving as a heat carrier is sealed. An ultrasonic motor for rotating integrally the straight tubular heat pipe component and the spiral heat pipe component is provided. A radiating fin structure is provided on the straight tubular heat pipe component positioned outside the liquid chamber. As a result, it is possible to make the device lighter, smaller and more reliable without decreasing the cooling performance as compared to conventional cooling devices.

13 Claims, 9 Drawing Sheets

COOLING DEVICE

BACKGROUND OF THE INVENTION

1. Field of the Invention

The present invention relates to cooling devices, and more particularly, to a cooling device for cooling liquid such as oil, water and the like.

2. Description of the Background Art

Conventionally, cooling devices for cooling liquids using various cooling systems have been invented. As an example of such a cooling device for cooling liquid, a cooling device for engine oil i.e. an oil cooler, for example installed in an automobile and the like will be described with reference to FIGS. 9 to 11. FIG. 9 is a plan view showing a conventional oil cooler. FIG. 10 is an internal plan view of the oil cooler shown in FIG. 9. FIG. 11 is a front view of the oil cooler shown in FIG. 9.

Referring to FIGS. 9 and 11, a conventional oil cooler 50 includes an oil inlet 51 through which engine oil is supplied, an oil outlet 52 through which the engine oil cooled by oil cooler 50 is discharged, a water inlet 53 through which cooling water for cooling the engine oil is supplied, and a water outlet 54 through which the cooling water is discharged after cooling the engine oil.

Next, referring to FIG. 10, by an internal structure of the conventional oil cooler 50 will be described. Referring to FIG. 10, a plurality of panels 55 are disposed approximately parallel with each other and with a predetermined space from each other in the interior of conventional oil cooler 50 so that a plurality of passages 56 for engine oil passing through the oil cooler 50 are defined. Passages 56 for engine oil and passages 57 for cooling water are defined by panels 55.

The engine oil supplied through oil inlet 51 is discharged from oil outlet 52 after passing passages 56 for engine oil defined by the plurality of panels 55. Passage 57 for cooling water are provided adjacent to passages 56 for engine oil. Because of this structure, the engine oil is cooled by the cooling water when it passes through passages 56 for engine oil.

The cooling water is introduced into oil cooler 50 from water inlet 53 to be discharged out of oil cooler 50 from water outlet 54 after passing through passages 57 for cooling water. When the cooling water passes through passages 57 by cooling water, it removes heat from the engine oil passing through passages 56 for engine oil provided adjacent to passages 57 for cooling water to cool the engine oil.

As described above, since the engine oil is cooled by the cooling water introduced into passages 57 for cooling water, it is preferred that a number for passages 57 of cooling water and a number of passages 56 for engine oil are provided in order to cool the engine oil more effectively. Provision of many passages 57 and passages 56 makes it possible to remove heat from the engine oil more effectively.

However, oil cooler 50 of a conventional type having the above-described structure has the following problems.

From the view point of improvement of performance such as fuel costs, automobiles lighter in weight are preferable. Therefore, it is necessary to make lighter components such as an oil cooler and the like provided as equipment on the automobile. However, as described above, in an oil cooler 50 of a conventional type, it is necessary to provide more panels 55 in order to enhance cooling efficiency.

As described above, by increasing the number of panels 55, oil cooler 50 is made larger, causing a problem that the weight is accordingly larger. For an automobile belonging to the formula 1 type, for example, it is very important to make the automobile lighter in weight. For an automobile of such a type, it is extremely disadvantageous to have components larger in weight.

In order to prevent the device from being made larger, there is one method considered in which the width of passages 57 for cooling water and passages 56 for engine oil defined by panels 55 is made smaller. However, this method brings about a smaller internal structure of oil cooler 50, whereby processing becomes difficult and precision of processing is lowered. As a result, a defect such as a gap occurs in the passage, and there is a high possibility that the engine oil and the cooling water are mixed with each other.

Furthermore, in order to introduce the cooling water into oil cooler 50, it is necessary to have a pump for supplying the cooling water. Therefore, it is necessary to have a space for the pump for supplying the cooling water in a limited space in the automobile. In addition to this, there may be a problem that, when the automobile rounds a curve, circulation of the cooling water is degraded by the centrifugal force.

SUMMARY OF THE INVENTION

One object of the present invention is to provide a cooling device which can be made lighter and smaller without lowering its cooling performance.

Another object of the present invention is to provide a cooling device which can reduce its manufacturing cost without lowering its cooling performance.

Still another object of the present invention is to provide a cooling device having a higher reliability without lowering its cooling performance.

The cooling device according to the present invention includes a liquid chamber having an inlet through which liquid is supplied and an outlet through which the liquid is discharged, a heat pipe including a straight tubular heat pipe component extending from the inside of the liquid chamber to the outside of the liquid chamber and a spiral heat pipe component disposed in the liquid chamber for communicating with the straight tubular heat pipe component and extending to surround the same spirally, a working fluid serving as a heat carrier sealed in the interior space communicating with the straight tubular heat pipe component and the spiral heat pipe component, and driving means for rotating integrally the straight tubular heat pipe component and the spiral heat pipe component.

A flow control disk for controlling the liquid flow rate passing through the liquid chamber is preferably provided at the outlet side of the liquid chamber. The straight tubular heat pipe component preferably has a heat radiating portion positioned outside the liquid chamber. A capillary tube for collecting the working fluid condensed in the above-described heat radiating portion to be fed back toward the inlet side of the liquid chamber is provided inside the straight tubular heat pipe component. The straight tubular heat pipe component positioned outside the liquid chamber preferably has a plurality of heat radiating fins extending radially.

In the cooling device according to the present invention, a portion of the straight tubular heat pipe component positioned in the liquid chamber and the spiral heat pipe component serve as a heat receiving portion. The working fluid as a heat carrier is sealed in the internal space where the straight tubular heat pipe component and the spiral heat pipe component communicate with each other. The working fluid removes heat from the high temperature liquid supplied in the liquid chamber to convert the state of the working fluid from the liquid phase into the gas phase.

A part of the working fluid turned into the gas phase goes up through the straight tubular heat pipe component to move to a portion of the straight tubular heat pipe component outside the liquid chamber. The straight tubular heat pipe component positioned outside the liquid chamber serves as a heat radiating portion. More specifically, the working fluid in the gas phase which has moved into the straight tubular heat pipe component positioned outside the liquid chamber, there radiates heat and becomes condensed.

The condensed working fluid again moves to the straight tubular heat pipe component positioned inside the liquid chamber through the inner wall surface of the straight tubular heat pipe component. By repetition of such operations, it is possible to remove heat from the high temperature liquid supplied into the liquid chamber to cool the high temperature liquid.

On the other hand, inside the spiral heat pipe component, the working fluid is also turned into the gas phase to go up through the space within the spiral heat pipe component. Through the communicating portion of the spiral heat pipe component and the straight tubular heat pipe component, the working fluid in the gas phase moves to the straight tubular heat pipe component portion outside the liquid chamber. Similar to the above case, heat is radiated from the straight tubular heat pipe component portion outside the liquid chamber whereby the working fluids is condensed to again move to the straight tubular heat pipe component portion inside the liquid chamber.

Integral rotation of the straight tubular heat pipe component and the spiral heat pipe component by the driving means makes it possible to forcefully feed the high temperature liquid introduced into the liquid chamber from the inlet portion of the liquid chamber to the outlet portion thereof. By rotation of the spiral heat pipe component and the straight tubular heat pipe component, it is possible to increase the substantial effective contact area of the high temperature liquid with the spiral heat pipe component and the straight tubular heat pipe component. More specifically, by feeding the high temperature liquid with stirring, it is possible to increase substantially the effective contact area of the straight tubular heat pipe component and the spiral heat pipe component with the high temperature liquid, that is to say, the turbulence caused by the stirring improves the effectiveness of the heat transfer. As a result, it is possible to enhance the efficiency of heat reception from the liquid of a high temperature.

When a liquid flow control disk is provided inside the liquid chamber, it is possible to control the flow rate of the high temperature liquid passing through the liquid chamber. As a result, it is possible to avoid the condition where the high temperature liquid is discharged without having a sufficient amount of heat removed at the heat receiving portion, whereby it is possible to cool the high temperature liquid reliably.

When a capillary tube through which the liquid is fed back is provided inside the straight tubular heat pipe component, the working fluid condensed at the heat radiating portion is fed back toward the inlet side of the liquid chamber through the capillary tube. Since the capillary tube is provided spaced apart from the inner wall surface of the straight tubular heat pipe component, the condensed working fluid still in the liquid phase is easily fed toward the inlet side of the liquid chamber through the capillary tube.

Therefore, it is possible to promote circulation of the working fluid and to enhance the cooling efficiency. When a heat radiating fin is provided at the straight tubular heat pipe component positioned outside the liquid chamber, it is possible to radiate heat from the working fluid more effectively at the heat radiating portion. As a result, it is possible to promote condensation of the working fluid, resulting in improvement of the cooling efficiency.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS AND OF THE BEST MODE OF THE INVENTION

Figure 1:
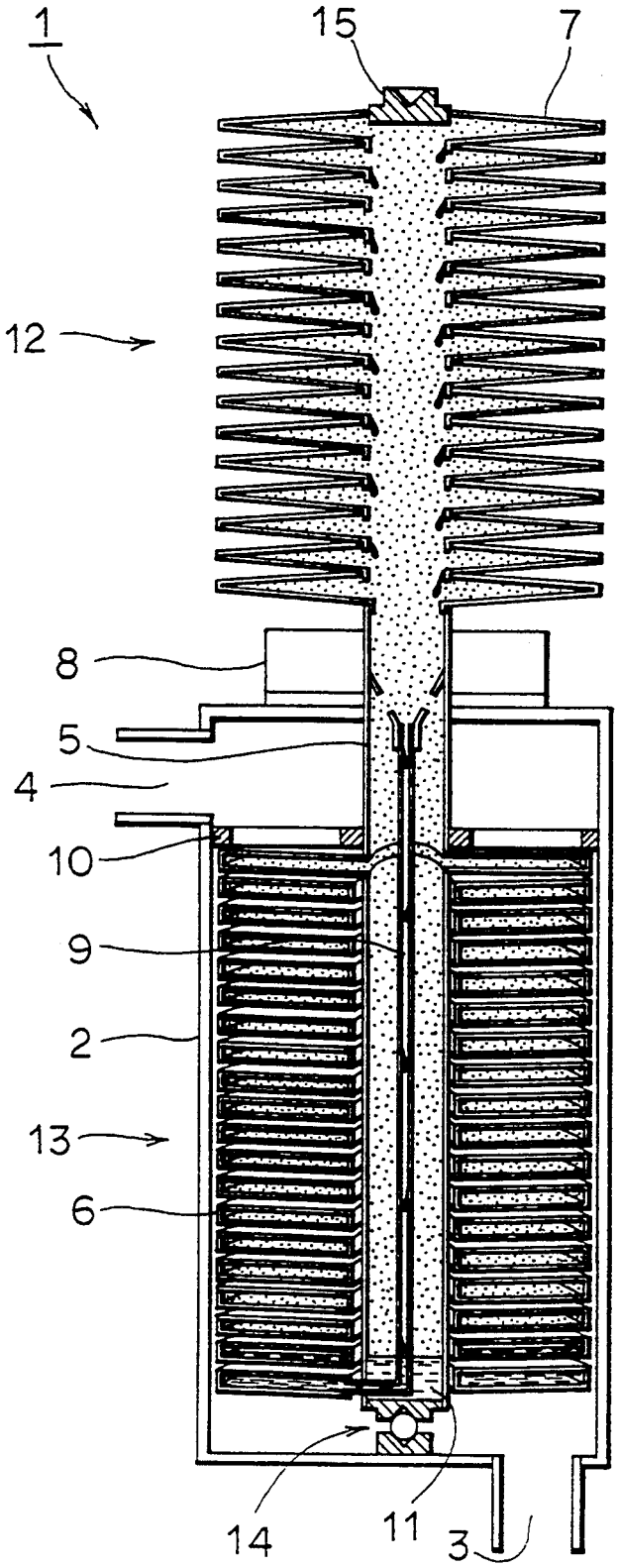
FIG. 1 is a cross section showing an oil cooler of a first embodiment according to the present invention.

One embodiment according to the present invention will now be described with reference to FIGS. 1 to 7. FIG. 1 is a cross section showing the oil cooler of the first embodiment according to the present invention. Referring to FIG. 1, an oil cooler 1 includes a liquid chamber 2 through which liquid of a high temperature passes. Liquid chamber 2 is provided with a liquid inlet 3 through which the high temperature liquid is supplied, and a liquid outlet 4 through which the liquid is discharged after heat has been removed therefrom, whereby it has been cooled.

A straight tubular heat pipe component 5 is provided to extend from inside to outside of liquid chamber 2. Support members 14, 15 for supporting straight tubular heat pipe component 5 in a rotatable manner are provided at both ends of straight tubular heat pipe component 5. A spiral heat pipe component 6 extending to surround spirally the straight tubular heat pipe component 5 is provided around a portion of straight tubular heat pipe component 5 positioned inside liquid chamber 2. Spiral heat pipe component 6 and straight tubular heat pipe component 5 communicate with each other at a predetermined portion to form together a heat pipe.

A working fluid 11 serving as a heat carrier is sealed inside of the straight tubular heat pipe component 5 and the internal space of spiral heat pipe component 6 which are in communication with each other. In the vicinity of liquid outlet 4 of liquid chamber 2, a control panel or member 10 is provided for controlling the flow rate of the high temperature liquid fed into liquid chamber 2. A capillary tube 9 serving as a return flow passages for condensed working fluid 11 is provided in the inside of straight tubular heat pipe component 5 so that working fluid 11 condensed at a portion of straight tubular heat pipe component 5 outside liquid chamber 2 is fed back more quickly within component 5 to the vicinity of liquid inlet 3 of liquid chamber 2.

An ultrasonic motor 8 for integrally rotating straight tubular heat pipe component 5 and spiral heat pipe component 6 is arranged outside liquid chamber 2 to surround the outer periphery of straight tubular heat pipe component 5. A heat radiating fin 7 is provided at the outer periphery of straight tubular heat pipe component 5 positioned outside liquid chamber 2. Heat radiating fin 7 serves to effectively radiate heat carried by incoming working fluid 11 which is in a gas phase after being evaporated inside liquid chamber 2.

A portion of straight tubular heat pipe component 5 positioned outside liquid chamber 2 including heat radiating fin 7 serves as a heat radiating portion 12 of the heat pipe. A portion of straight tubular heat pipe component 5 and spiral heat pipe component 6 positioned inside liquid chamber 2 serve as a heat receiving portion 13 of the heat pipe.

The operation of the oil cooler of the first embodiment according to the present invention having the above-described structure will now be described. Liquid such as engine oil of a high temperature is fed into liquid chamber 2 through liquid inlet 3. The high temperature liquid comes into contact with spiral heat pipe component 6 and straight tubular heat pipe component 5. As a result, heat from the high temperature liquid is transmitted to working fluid 11 sealed inside straight tubular heat pipe component 5 and spiral heat pipe component 6. Working fluid 11 turns from the liquid phase into gas phase, thereby removing heat from the high temperature liquid.

At this time, spiral heat pipe component 6 and straight tubular heat pipe component 5 are rotated at a predetermined speed by ultrasonic motor 8. Ultrasonic motors are known as such, in general. An ultrasonic motor converts a strong ultrasonic vibration force into a one-directional linear or circular motion. An ultrasonic motor includes, for example, a piezoelectric stator which is driven to be oscillatingly distorted in a rotational direction. As a result, a rotor in frictional contact with the stator is driven to rotate. The ultrasonic motor 8 in the present invention provides a rotational driving force to rotate the heat pipe components 5 and 6. Integral rotation of spiral heat pipe component 6 and straight tubular heat pipe component 5 makes it possible to feed with stirring the high temperature liquid from the inlet side to the outlet side of liquid chamber 2. As a result, it is possible to increase the substantial effective contact area of the high temperature liquid with spiral heat pipe component 6 and straight tubular heat pipe component 5, whereby heat can effectively be removed from the high temperature liquid.

Working fluid 11 gasified inside straight tubular heat pipe component 5 goes up through inside straight tubular heat pipe component 5 to move to the interior of the portion of straight tubular heat pipe component 5 positioned outside liquid chamber 2. More specifically, working fluid 11 moves to heat radiating portion 12. Working fluid 11 gasified inside spiral heat pipe component 6 also goes up through spiral heat pipe component 6 to move to heat radiating portion 12 through a communicating portion of spiral heat pipe component 6 and straight tubular heat pipe component 5.

In heat radiating portion 12, a space communicating with an internal space of straight tubular heat pipe component 5 is formed inside heat radiating fin 7 in a manner shown in FIG. 1. As a result, it is possible for gasified working fluid 11 to reach the vicinity of a tip portion of heat radiating fin 7, making it possible to effectively radiate heat included in working fluid 11 to the outside.

After radiating heat outside by heat radiating fin 7 as described above, working fluid 11 is condensed. Condensed working fluid 11 flows down the inner wall surface of straight tubular heat pipe component 5. Working fluid 11 is fed back to a portion of spiral heat pipe component 6 positioned in the vicinity of liquid inlet 3 of liquid chamber 2, through capillary tube 9 installed at a predetermined position inside straight tubular heat pipe component 5.

Provision of capillary tube 9 makes it possible to feed working fluid 11 more quickly while still in its liquid phase, after being condensed in heat radiating portion 12 to the vicinity of the inlet portion of liquid chamber 2. As a result, it is possible to promote circulation of working fluid 11 inside oil cooler 1. In other words, it is possible to enhance the cooling efficiency of working fluid 11.

Heat is removed from the high temperature liquid as described above. However, when the liquid of a high temperature passes through liquid chamber 2 at too high a speed, the liquid cannot be sufficiently cooled. Therefore, liquid flow control disk 10 for controlling the flow rate of the liquid passing through liquid chamber 2 is provided in liquid chamber 2. By provision of control disk 10, it is possible to properly control the flow rate of the liquid passing through liquid chamber 2, making it possible to effectively remove heat from the high temperature liquid.

More detailed description will now be given for each component of the oil cooler having the above-described structure with reference to FIGS. 2 to 7, which show components of oil cooler 1 in the first embodiment.

Figure 2:
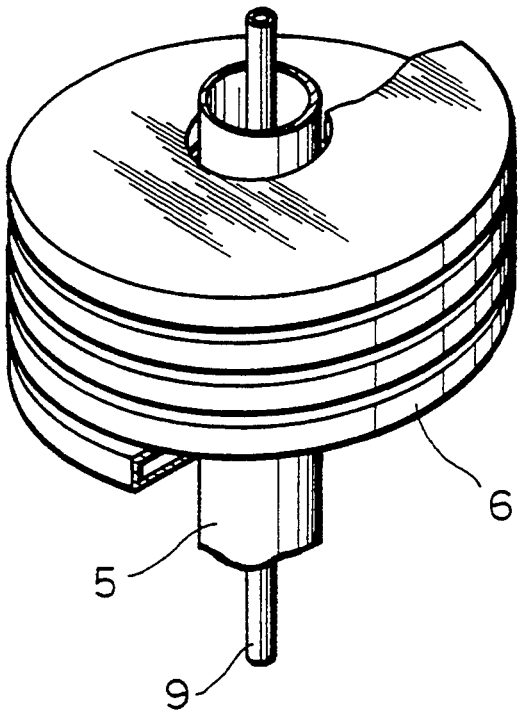
FIG. 2 is a partial perspective view showing a straight tubular heat pipe component, a spiral heat pipe component and a capillary tube serving as components of the oil cooler in the first embodiment according to the present invention.

Referring to FIG. 2, spiral heat pipe component 6 is provided to surround spirally the straight tubular heat pipe component 5. Spiral heat pipe component 6 and straight tubular heat pipe component 5 communicate with each other at a predetermined position (not shown) and may be rotated integrally. By rotating of spiral heat pipe component 6 and straight tubular heat pipe component 5, it is possible to feed the high temperature liquid existing around spiral heat pipe component 6 and straight tubular heat pipe component 5 in a desired direction. Rotation of spiral heat pipe component 6 and straight tubular heat pipe component 5 causes the high temperature liquid surrounding the same to be stirred, whereby it is also possible to increase the substantial or effective contact area of spiral heat pipe component 6 and straight tubular heat pipe component 5 with the high temperature liquid.

As described above, it is possible to remove heat from the high temperature liquid efficiently. Provision of capillary tube 9 inside straight tubular heat pipe component 5 makes it possible to supply the working fluid condensed at heat radiating portion 12 directly to the heat receiving portion in the vicinity of the inlet portion of liquid chamber 2, that is, the inlet area to which the liquid of a high temperature is supplied. As a result, it is possible to promote circulation of working fluid 11, whereby the efficiency of cooling can be improved.

Figure 3:
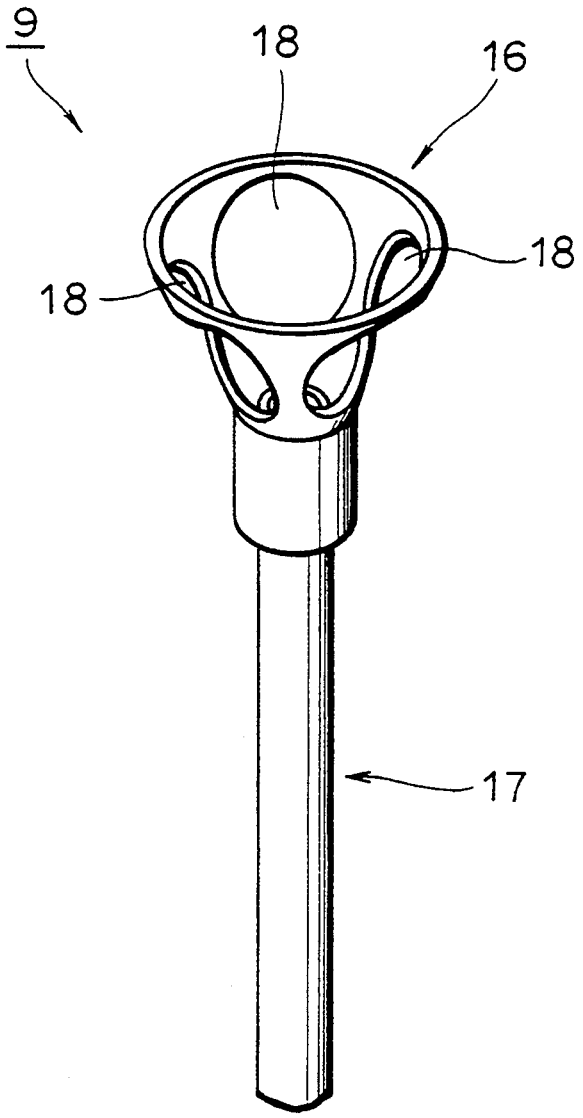
FIG. 3 is a perspective view showing the capillary tube incorporated into the oil cooler of the first embodiment according to the present invention.

As shown in FIG. 3, capillary tube 9 includes a tapered portion 16 and a straight tubular portion 17. An opening 18 is provided in the tapered portion 16. It is preferred that tapered portion 16 of capillary tube 9 is disposed in the vicinity of the boundary of heat radiating portion 12 and heat receiving portion 13. As a result, it is possible to collect efficiently working fluid 11 condensed in heat radiating portion 12 and to feed the same into straight tubular portion 17.

Being mainly in its liquid phase, working fluid 11 fed into straight tubular portion 17 is supplied to the vicinity of liquid inlet 3 of liquid chamber 2 through the interior of straight tubular portion 17. All working fluid 11 condensed in heat radiating portion 12 is not collected inside straight tubular portion 17. Some of working fluid 11 flows down the outer periphery of straight tubular portion 17 and the interior surface of straight tubular heat pipe component 5. However, even in this case, working fluid 11 absorbs heat from the surroundings while working fluid 11 is fed to the vicinity of liquid inlet 3 of liquid chamber 2 along the outer periphery of straight tubular portion 17 or the interior surface of straight tubular heat pipe component 5, or while working fluid 11 flows down the outer periphery of straight tubular portion 17 or the interior surface of straight tubular heat pipe component 5.

Opening 18 is provided in tapered portion 16. Working fluid 11 gasified in straight tubular heat pipe component 5 or spiral heat pipe component 6 moves to heat radiating portion 12 through opening 18. More specifically, with regard to capillary tube 9, working fluid 11 gasified in heat receiving portion 13 is fed to heat radiating portion 12 through opening 18, and working fluid 11 condensed in heat radiating portion 12 is fed back to the vicinity of liquid inlet 3 of liquid chamber 2 mainly through capillary tube 9. As a result, it is possible to promote circulation of working fluid 11.

Figure 4:
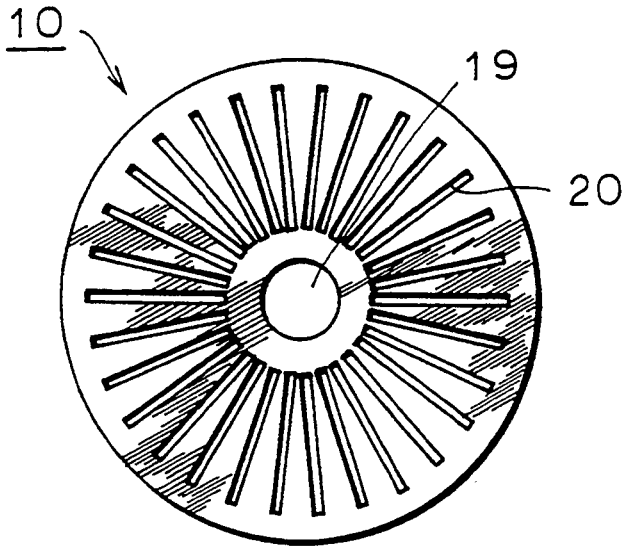
FIG. 4 is a plan view showing a liquid flow control disk incorporated into the oil cooler of the first embodiment according to the present invention.

FIG. 4 is a plan view showing liquid flow control disk 10. Referring to FIG. 4, a penetrating hole 19 for receiving straight tubular heat pipe component 5 is provided at the center portion of control disk 10. In this case, a plurality of penetrating slots 20 extending radially from the vicinity of the center portion of control disk 10 are provided. The liquid of a high temperature such as engine oil passes through slots 20.

By properly selecting the shape, size, number and the like of slots 20, it is possible to control the flow rate of the high temperature liquid passing through liquid chamber 2. More specifically, it is possible to prevent the high temperature liquid from passing through liquid chamber 2 at too high a speed. As a result, it is possible to ensure the desired flow rate of the high temperature liquid, as well as to remove heat from the high temperature liquid efficiently. It should be noted that the shape, size, number and the like of slots 20 of control disk 10 are not limited to those of FIG. 4, and that another shape, size, number and the like may be considered within the scope of the invention.

Figure 5:
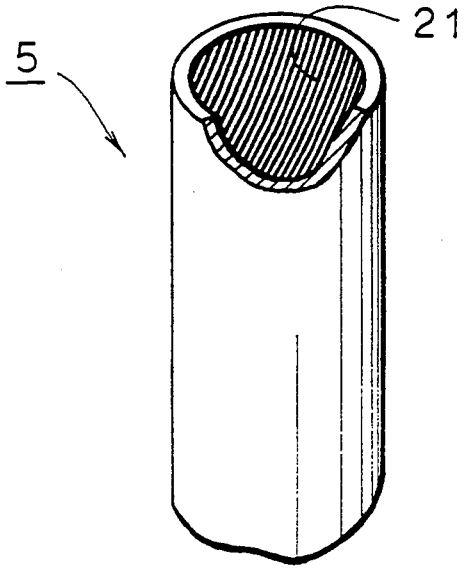
FIG. 5 is a partially sectioned perspective view showing the structure of the inner wall surface of the straight tubular heat pipe component.

Referring to FIG. 5, the form of the inner wall surface of straight tubular heat pipe component 5 will now be described. As shown in FIG. 5, a number of fine grooves 21 are formed in the inner wall surface of straight tubular heat pipe component 5. Formation of a number of fine grooves 21 causes working fluid 11 still existing in the liquid phase to flow down grooves 21 in the inner wall surface of straight tubular heat pipe component 5. Working fluid 11 removes heat from straight tubular heat pipe 5 by flowing down grooves 21 to be again gasified. As a result, working fluid 11 can also remove heat from the high temperature liquid by flowing down inside straight tubular heat pipe component 5.

Figure 6:
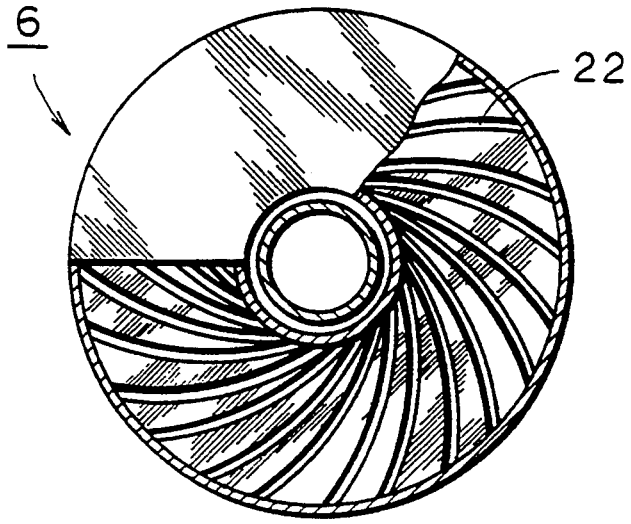
FIG. 6 is a partially sectioned plan view showing the inner wall surface of the spiral heat pipe component.

Referring to FIG. 6, the structure of the inner wall surface of spiral heat pipe component 6 will now be described. Similar to the inner wall surface of straight tubular heat pipe component 5, a number of fine grooves 22 are provided in the inner wall surface of spiral heat pipe component 6. Grooves 22, formed along the gradient of spiral heat pipe component 6, are provided so that working fluid 11 existing in the liquid phase can flow down grooves 22. As a result, working fluid 11 in the liquid phase flows down the inner wall surface of spiral heat pipe component 6 along grooves 22. When flowing down, working fluid 11 in the liquid phase removes heat from spiral heat pipe component 6 and is thereby gasified.

Figure 7:
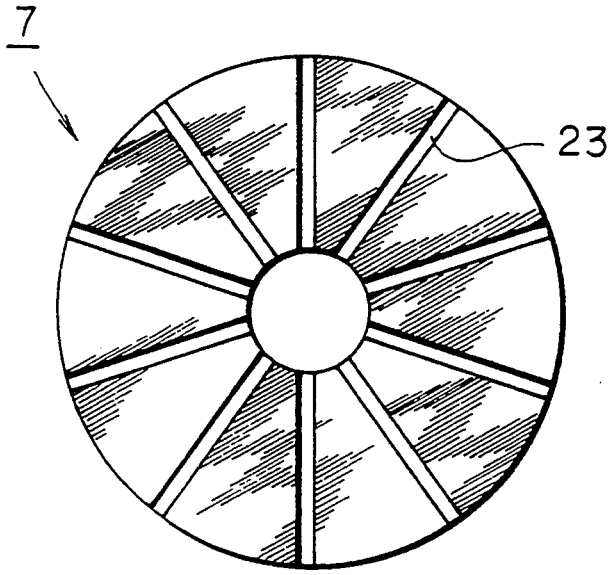
FIG. 7 is a plan view of a heat radiating fin.

Referring to FIG. 7, description will be given to the planar shape of heat radiating fin 7 will now be described. As shown in FIG. 7, a plurality of grooves 23 are provided in a radial manner on the outer periphery of heat radiating fin 7. Provision of a plurality of grooves 23 makes it possible to increase the surface area of heat radiating fin 7, whereby the efficiency of radiating heat can be improved. Grooves 23 also facilitate the flow of the fluid existing around heat radiating fin 7 along heat radiating fin 7. As a result, it is possible to further improve the efficiency of radiating heat.

As for the shape of the surface of heat radiating fin 7, it is sufficient that a concave-convex structure is formed thereon. Therefore, although the case where grooves 23 are formed on the surface of heat radiating fin 7 was described, convex portions may be provided to form the concave-convex structure on the surface of heat radiating fin 7 in place of grooves 23. Although grooves 23 are provided radially in the above case, they are not limited thereto. As for the internal shape of heat radiating fin 7, the case where the internal space is formed was described in the above first embodiment. However, heat radiating fin 7 may be of a plate where the internal space is not formed.

Figure 8:
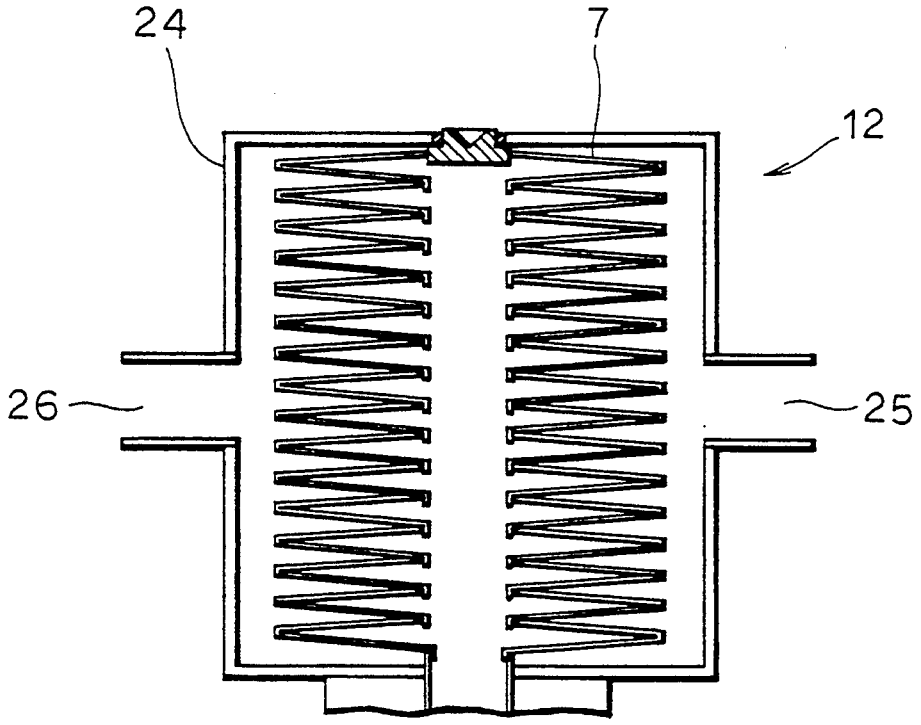
FIG. 8 is a cross section showing another arrangement of a heat radiating portion of the oil cooler according to the present invention.
Figure 9:
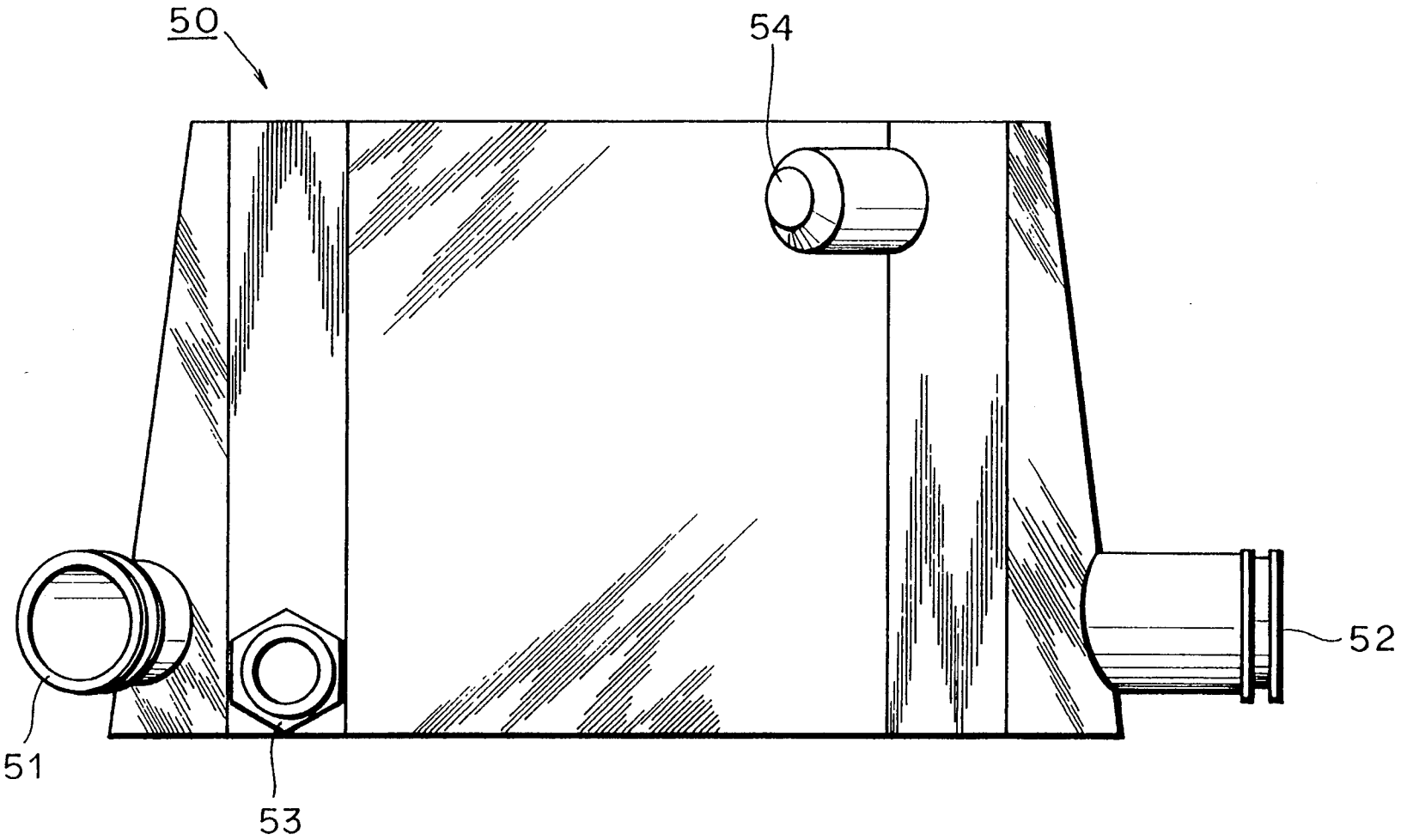
PRIOR ART FIG. 9
FIG. 9 is a plan view showing a conventional oil cooler.
Figure 10:
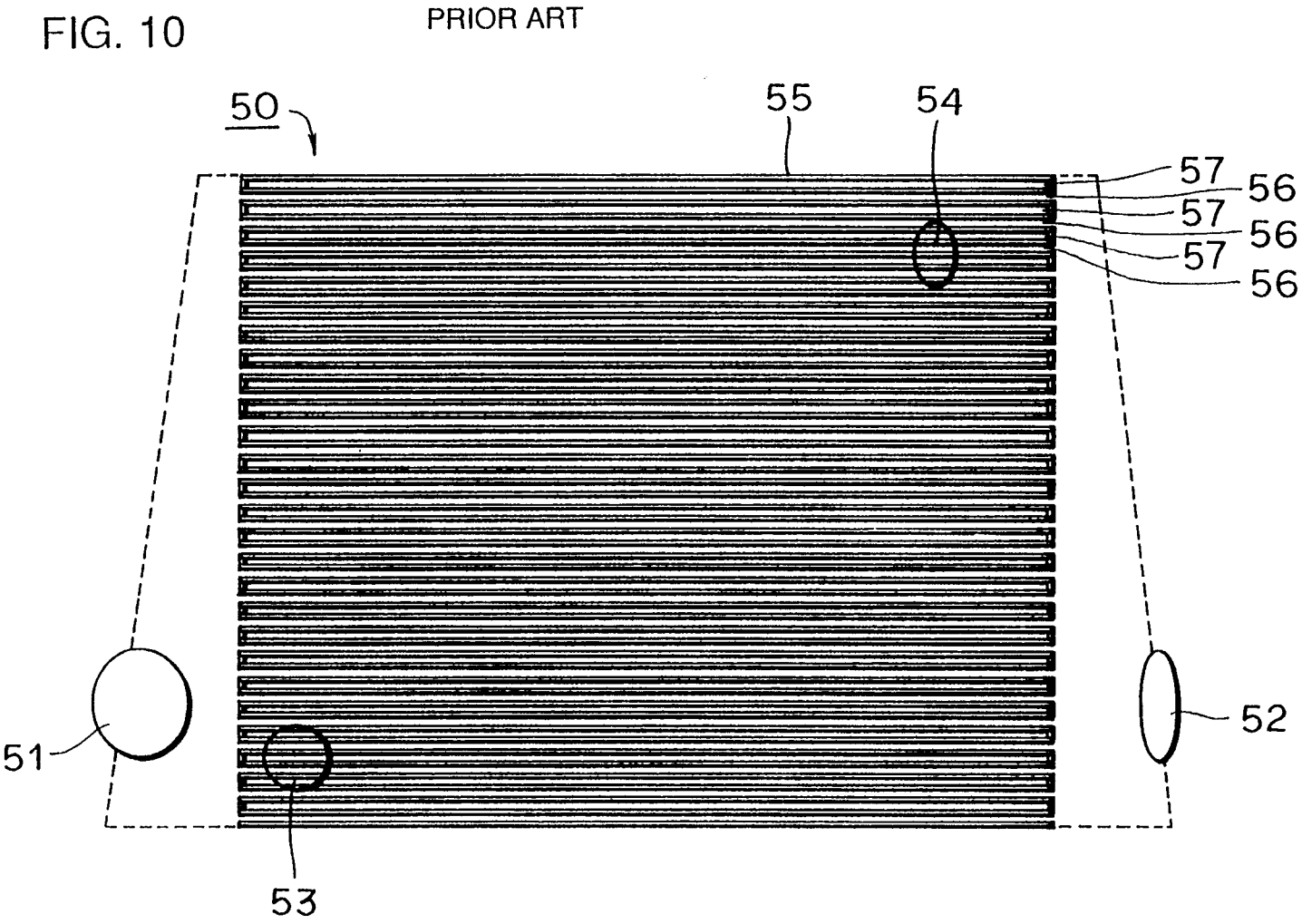
PRIOR ART FIG. 10
FIG. 10 is a partial plan view showing the internal structure of the conventional oil cooler.
Figure 11:
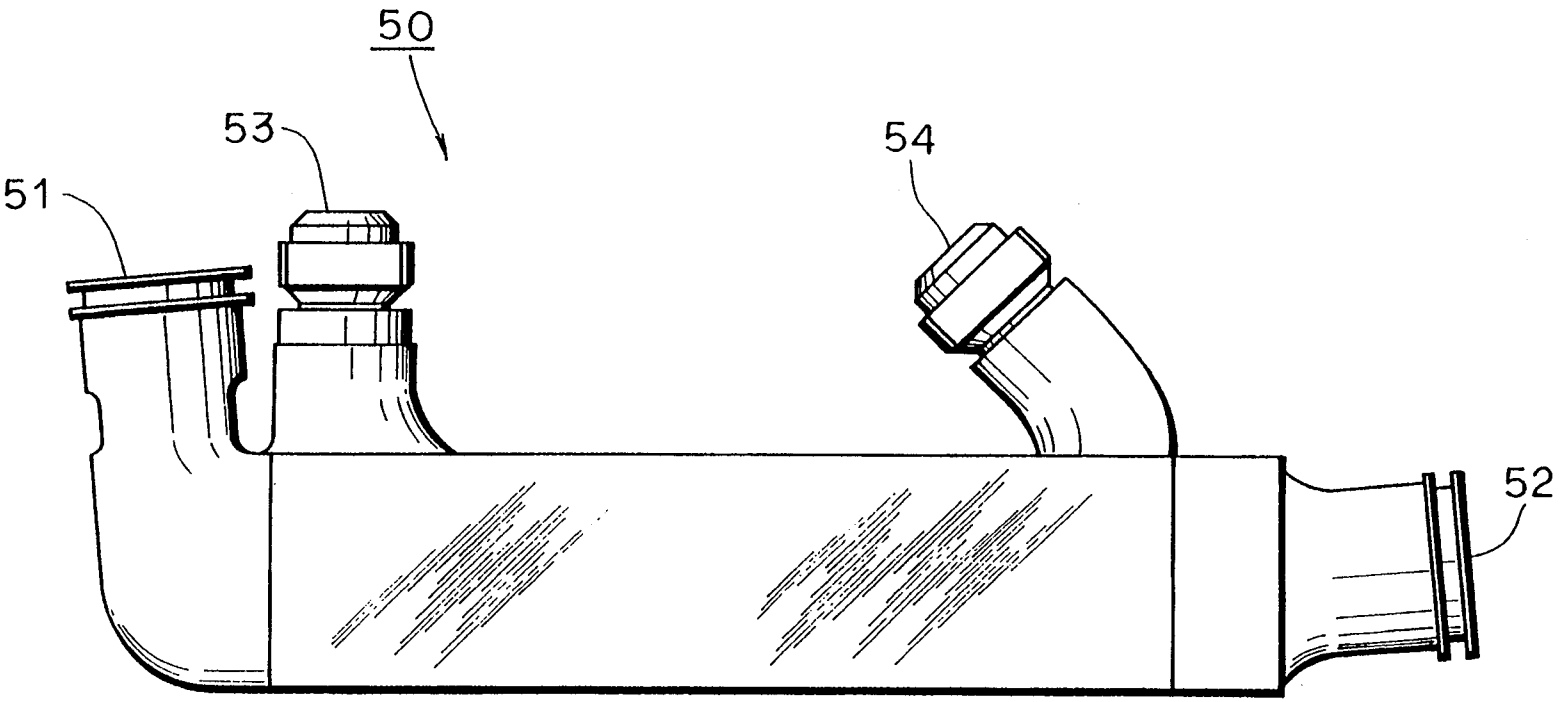
PRIOR ART FIG. 11
FIG. 11 is a front view of the conventional oil cooler.

Referring to FIG. 8, another arrangement of heat radiating portion 12 will be described. In the first embodiment, heat radiating portion 12 is of an air-cooled type in which heat is removed by air. However, heat radiating portion 12 may be of a type in which heat is removed by liquid such as water by providing a liquid-tight chamber 24 to surround heat radiating portion 12. Chamber 24 is provided with an inlet 25 through which liquid such as water serving as a cooling carrier is introduced, and an outlet 26 through which the liquid carrying heat radiated at heat radiating portion 12 is discharged. The liquid serving as a cooling carrier such as water is introduced into chamber 24 through inlet 25 to remove heat from heat radiating fin 7, and discharged through outlet 26.

In the above embodiments, the case where the present invention is applied to an oil cooler for cooling engine oil of an automobile and the like was described. However, the present invention can be applied to an oil cooling device in a radiator or a transformer. The present invention can further be applied to a cooling device for cooling liquid other than oil. Although ultrasonic motor 8 was used as driving means of straight tubular heat pipe component 5 and spiral heat pipe component 6 in the above embodiment, other driving means may be used.

As described above, according to the present invention, the device can be made smaller and made lighter in weight with an excellent cooling performance maintained. More specifically, the weight of the conventional oil cooler of approximately 2.4 kg can be reduced to approximately 1.5 kg according to the present invention. When an air-cooled type is adopted, it is not necessary to feed water for cooling by a pump as it is in the conventional device. In other words, it is possible to utilize the space otherwise necessary for the pump for another purpose.

In the conventional cooler, in order to improve the cooling efficiency, it was necessary to provide a number of passages for cooling water by using a number of panels, resulting in a larger device. However, according to the present invention, since only a straight tubular heat pipe component and a spiral heat pipe component to surround the same are provided, it is possible to make the device smaller in size compared to the conventional example.

Furthermore, since it was conventionally necessary to provide a number for fine passages for cooling water, leakage of the cooling water occurred. However, according to the present invention, the spiral heat pipe component and the straight tubular heat pipe component form a closed space. Therefore, it is not necessary to have a fine structure in which a passage for cooling water and a passage for high temperature liquid such as engine oil are provided alternately, whereby leakage cannot occur easily.

According to the present invention, it is not necessary to fabricate a device of a complicated structure in which a passage for cooling water and a passage for liquid such as engine oil are provided adjacent to each other, resulting in reduction of manufacturing costs. As described above, according to the present invention, it is possible to make the device smaller and lighter, to improve reliability, and to reduce manufacturing costs without decreasing the cooling performance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooling device for cooling liquid, comprising:

a liquid chamber having an inlet through which said liquid is supplied, and an outlet through which said liquid is discharged;

a heat pipe comprising a straight tubular heat pipe component having a first internal space and extending from the inside to the outside of said liquid chamber and a spiral heat pipe component having a second internal space and being disposed in said liquid chamber, said second internal space communicating with said first internal space of said straight tubular heat pipe component and said spiral heat pipe component extending to surround spirally said straight tubular heat pipe component;

said cooling device further comprising a working fluid sealed within said first and second internal spaces through which said straight tubular heat pipe component and said spiral heat pipe component communicate with each other; and driving means for rotating integrally said straight tubular heat pipe component and said spiral heat pipe component.

2. The cooling device as recited in claim 1, further comprising a flow control disk arranged at said outlet of said liquid chamber.

3. The cooling device as recited in claim 2, wherein a penetrating hole for controlling the flow rate of said liquid is provided in said control disk.

4. The cooling device as recited in claim 3, wherein a plurality of said holes is provided and at least one of said holes is a slit extending radially.

5. The cooling device as recited in claim 1, wherein said driving means is an ultrasonic motor, said ultrasonic motor being provided at an end of said liquid chamber to encircle said straight tubular heat pipe component.

6. The cooling device as recited in claim 1, wherein said straight tubular heat pipe component includes a heat radiating portion positioned outside said liquid chamber and a heat receiving portion positioned inside said liquid chamber, and a capillary tube is provided in said first internal space of said straight tubular heat pipe component for collecting said working fluid condensed in said heat radiating portion to feed back said condensed working fluids to said heat receiving portion.

7. The cooling device as recited in claim 6, wherein said capillary tube has one end arranged at said heat radiating portion and one end arranged in said heat receiving portion near said inlet of said liquid chamber.

8. The cooling device as recited in claim 6, wherein said capillary tube comprises a tapered portion at one end of said capillary tube, said tapered portion making contact with an inner wall surface of said straight tubular heat pipe component near a transition between said heat receiving portion and said heat radiating portion and said tapered portion having an opening through which said working fluid passes.

9. The cooling device as recited in claim 1, further comprising a plurality of heat radiating fins extending radially from a portion of said straight tubular heat pipe component positioned outside said liquid chamber.

10. The cooling device as recited in claim 9, wherein a space communicating with said first internal space of said straight tubular heat pipe component is formed in the interior of said heat radiating fins.

11. The cooling device as recited in claim 9, wherein said heat radiating fins comprise a concave-convex structure on a surface of said heat radiating fins.

12. The cooling device as recited in claim 1, wherein a plurality of grooves is formed on an inner wall surface of at least one of said straight tubular heat pipe component and said spiral heat pipe component.

13. A heat pipe comprising a straight tubular heat pipe component having a first internal space and including a heat receiving portion and a heat rejecting portion, said heat pipe further comprising a spiral heat pipe component having a second internal space communicating with said first internal space, said spiral heat pipe component disposed spirally around said heat receiving portion, said heat pipe component further comprising a working fluid sealed within said first and second internal spaces.

* * * * *

UNITED STATES PATENT AND TRADEMARK OFFICE

CERTIFICATE OF CORRECTION

PATENT NO. : 5,345,998

DATED : 9/13/94

INVENTOR(S) : Akira Itoh

It is certified that error appears in the above-indentified patent and that said Letters Patent is hereby corrected as shown below:

On the title page, [57] Abstract, line 2, replace "bent" by --"heat".

Column 1, line 28, replace "by an" by --the--;
line 38, after "passing" insert --through--;
line 39, replace "Passage" by --Passages--;
line 48, replace "by" by --for--;
Column 2, line 6, replace "formula" by --Formula--;
line 9, replace "larger in" by --of greater--.
Column 3, line 36, replace "fluids" by --fluid--.
Column 5, line 17, replace "passages" by --passage--;
line 48, after "heat" insert --is transmitted--; delete "is";
line 49, delete "transmitted".
Column 6, line 63, delete "of".
Column 8, line 34, delete "description will be given to".
Column 12, line 1, delete "component".

Signed and Sealed this

Thirteenth Day of December, 1994

*Attest:*

Bruce Lehman

BRUCE LEHMAN

*Attesting Officer*

*Commissioner of Patents and Trademarks*